US006287389B1

(12) United States Patent
McGuire

(10) Patent No.: US 6,287,389 B1
(45) Date of Patent: Sep. 11, 2001

(54) METHOD OF ROBOTIC AUTOMOBILE PAINT STRIPPING

(75) Inventor: Dennis McGuire, Stuart, FL (US)

(73) Assignee: Ultrastrip Systems, Inc., Stuart, FL (US)

( * ) Notice: Subject to any disclaimer, the term of this patent is extended or adjusted under 35 U.S.C. 154(b) by 0 days.

(21) Appl. No.: 09/603,726

(22) Filed: Jun. 23, 2000

(51) Int. Cl.[7] ..... B08B 3/02; B08B 7/04

(52) U.S. Cl. ..... 134/18; 134/38; 134/42; 134/57 R

(58) Field of Search ..... 134/18, 38, 42, 134/57 R

(56) References Cited

U.S. PATENT DOCUMENTS

| | | | | |
|---|---|---|---|---|
| 3,584,327 | | 6/1971 | Murry . | |
| 3,623,309 | | 11/1971 | Stang et al. . | |
| 3,742,076 | | 6/1973 | Imai et al. . | |
| 4,182,000 | | 1/1980 | Fairbairn . | |
| 4,398,961 | | 8/1983 | Mason . | |
| 4,443,271 | | 4/1984 | Goerss . | |
| 4,858,264 | | 8/1989 | Reinhart . | |
| 5,839,112 | * | 11/1998 | Schreitmueller et al. | 705/4 |
| 5,986,234 | | 11/1999 | Matthews et al. . | |
| 6,013,308 | * | 1/2000 | Saito | 427/8 |
| 6,105,204 | * | 8/2000 | Scharwat | 15/322 |

* cited by examiner

*Primary Examiner*—Zeinab El-Arini
(74) *Attorney, Agent, or Firm*—McHale & Slavin, P.A.

(57) ABSTRACT

The present invention provides a computerized apparatus and method for stripping paint from a vehicle, such as an automobile, by utilizing ultra-high pressure waterjet technology in conjunction with a method and apparatus for creating and storing, in a database, digitized maps or templates which may conform to either the original shape of a vehicle, the shape of a vehicle subsequent to a collision, or both. The stored shapes may be retrieved and compared to verify the extent of damage, additionally the stored shapes may then be retrieved as needed and used to drive a precision ultra-high pressure waterjet nozzle constructed and arranged for removal of the painted finish from the vehicle's surface.

5 Claims, 2 Drawing Sheets

METHOD OF ROBOTIC AUTOMOBILE PAINT STRIPPING

FIELD OF THE INVENTION

This invention relates to a method and apparatus for paint removal and particularly relates to the removal of painted finishes from automobiles via the utilization of an ultra-high pressure water methodology carried out under robotic control.

BACKGROUND OF THE INVENTION

Presently, the method for the removal of paint from automobiles is by using a combination of hazardous chemical paint strippers and mechanical and hand sanding of the paint from the vehicle's surface. The environmental and worker health problems associated with using chemicals strippers are of epidemic proportions. All of the major automobile manufacturers have issued disclaimer notices to their dealerships that prohibit the use of chemical strippers and outline that the only approved method for stripping/removing the paint from their automobiles is by using a single edge razor blade. This recommended razor blade method is never used as it would require months to strip a vehicle and would destroy the original factory primer which is electrostacially applied.

Coating removal technology has typically accomplished removal of coatings such as alkyd primers, alkyd topcoats and acrylic nitrocellulose topcoats with solvent-based strippers which employed, for example, methylene chloride as a major component. However, the use of such materials is now prohibited as they are on the OSHA/EPA toxic materials listing.

Chemical paint strippers are also inappropriate for the removal of protective coatings from non-metallic organic matrix composite materials, for example those utilized for bumpers, grills, side view mirrors and similar structures previously formed as molded metallic articles. Chemical paint strippers cannot be used for paint removal from such composite materials because of the high risk of the stripper chemically attacking organic components of the material.

Alternative stripping processes, for example mechanical coating removal by the use of abrasive blasting techniques is one alternative to the use of chemical stripping. Techniques which include the utilization of abrasive media such as crushed corn cobs, glass beads, plastic beads, walnut shells, synthetic diamond dust, garnet particles, and dry ice carbon dioxide pellets have been employed in abrasive blasting processes. High pressure fluids such as water have also been used for the removal of coatings. All of these techniques have, however, met with limited success.

Accordingly, a cost-effective and safe arrangement for removing painted coatings would satisfy a longfelt need in the art, particularly if such a method and apparatus was capable of effectively removing coatings from automobiles, without injuring the factory installed primer.

DESCRIPTION OF THE PRIOR ART

U.S. Pat. No. 3,623,909 discloses an electrically heated tool and a method for using the tool in paint removal.

U.S. Pat. No. 4,182,000 teaches a hand held scraper-sander, as does U.S. Pat. No. 4,466,851 which concerns a hand held scraper that is especially suited for removing fragments of a gasket from automobile engine components.

U.S. Pat. No. 4,398,961 is directed towards a fuel combustion heated device and method of use thereof for removing old paint.

U.S. Pat. No. 4,443,271 concerns an apparatus and method used for cleaning floor grates employing high-pressure water jets.

U.S. Pat. No. 3,584,327 discloses an ultrasonic energy transmission system.

U.S. Pat. No. 4,858,264 is directed toward an ultrasonic assisted protective coating removal system, particularly for removing paint or similar coatings from aircraft.

U.S. Pat. No. 5,986,234 teaches a laser-based coating removal system for removal of surface coatings.

U.S. Pat. No. 3,742,076 discloses the use of ultrasonic transducers which are energized by compressed air, pressurized hydraulic fluid or other pressurized fluid sources of energy. The patent suggests that with such larger transducers, mechanically-supported and machine-guided arrangements such as robotic devices which can be programmed for the stripping of a predetermined shape and area may be desirable.

None of the prior art patents address the issue of removal of paints from an automobile surface solely by the use of ultra-high pressure waterjets, nor do they suggest the concept of precise control of such waterjets, as is achieved in the present invention, by the use of a robotically controlled system of operation.

SUMMARY OF THE INVENTION

The present invention provides a computerized apparatus useful for stripping paint from a vehicle, such as an automobile, by utilizing ultra-high pressure waterjet technology in conjunction with a method and apparatus for creating and storing, in a database, digitized maps or templates which may conform to either the original shape of a vehicle, the shape of a vehicle subsequent to a collision, or both. The stored shapes may be retrieved and compared to verify the extent of damage; additionally the stored shapes may then be retrieved as needed and used to drive a precision ultra-high pressure waterjet nozzle constructed and arranged for removal of the painted finish from the vehicle's surface.

The present invention is capable of selectively stripping away various layers of paint from the entire vehicle or from selected body areas leaving the original factory primer intact and undisturbed.

The instant invention utilizes a controlled automobile paint stripping system which only requires a single operator positioned outside the stripping booth at a computer console. A rotating nozzle having a multiplicity of waterjets similar to a showerhead rotating is maintained at a controlled distance from the surface of the automobile and directs ultra-high pressure water for selectively removing one or more layers of paint. The pressure of the water can vary from 25,000–60,000 psi. depending on the volume of water and pressure used and the standoff distance from the automobile.

Accordingly, it is an objective of the instant invention to provide an ultra-high pressure water assisted paint/protective coating removal method and apparatus.

It is a further objective of the instant invention to provide a paint/protective coating removal apparatus which operates with a degree of precision sufficient to selectively remove one or more layers of paint/protective coating without damage to the underlying primer or substructure.

It is yet another objective of the instant invention to provide an apparatus and method for removal of paint/protective coatings wherein the apparatus and method utilize a computer for storing vehicular shapes in a structured database, and a computer driven coating removal device for precision and selective removal of one or more layers thereof.

It is another object of the invention to provide a paint/protective coating removal arrangement which is suitable for use in combustible or other hazardous environments.

It is another object of the invention to provide a paint/protective coating removal arrangement which is safe for use with respect to the environment and with respect to human operators.

It is still a further object of the present invention to provide an apparatus and method for paint/protective coating removal wherein the method includes the step of progressively adding new vehicular shapes to the database including the steps of downloading archived vehicular shape digitized files or alternatively photographing the vehicle and scanning the photograph to digitize the image for downloading, comparing the stored versus the present images to assess vehicular damage, and utilizing the digitized shape to direct the paint/protective coating removal via ultra-high pressure water.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention is described in terms of a preferred specific embodiment, it will be readily apparent to those skilled in this art that various modifications, rearrangements and substitutions can be made without departing from the spirit of the invention. The scope of the invention is defined by the claims appended hereto.

Figure 1:
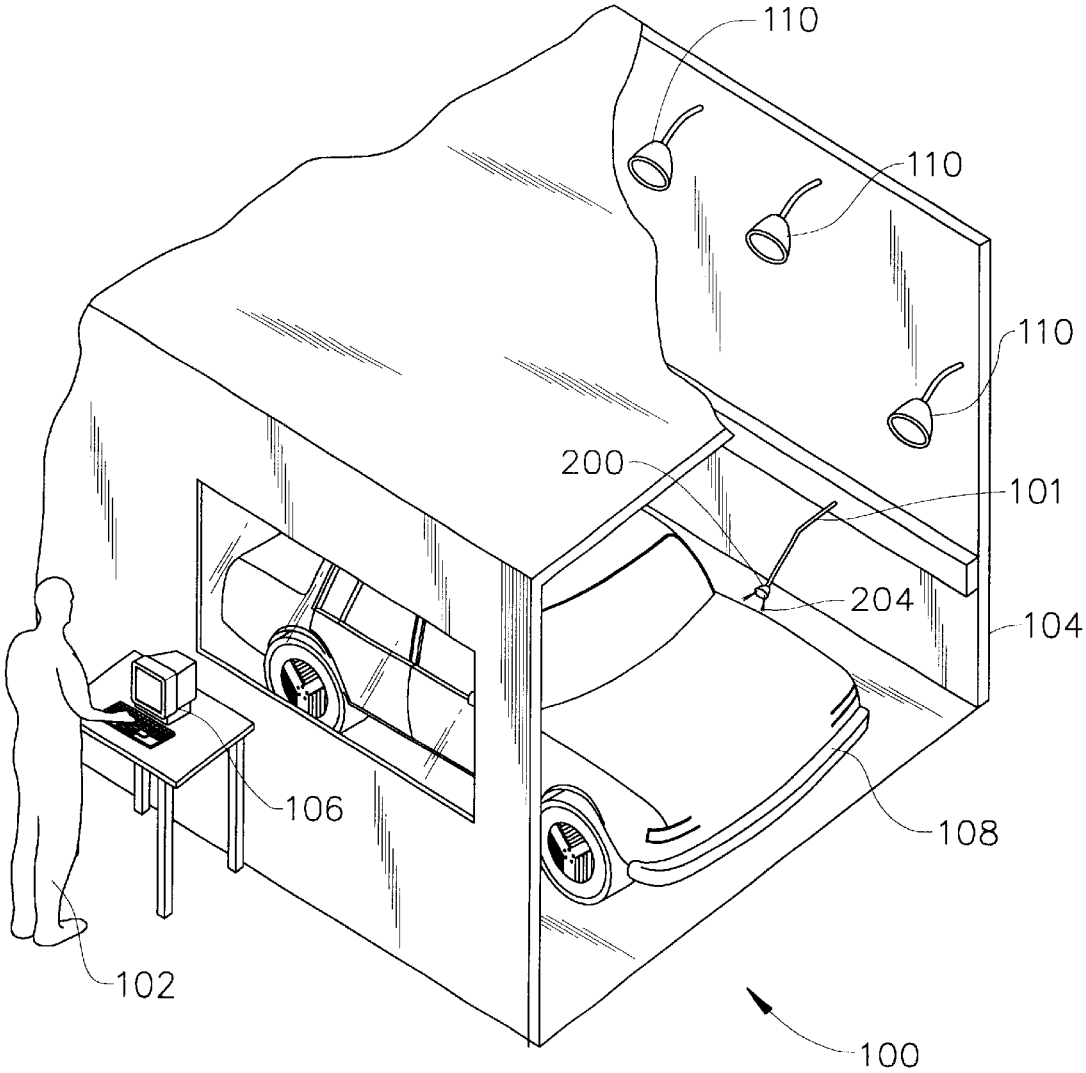
FIG. 1 illustrates a robotically controlled articulating arm vehicle paint stripping system.

In order to alleviate the propensity for surface damage from abrasive blasting and due to the unsuitability of chemical stripping agents for use in modern-day vehicle (e.g. automobile) coating removal, the present invention utilizes a robotically controlled articulating arm paint stripping system 100 as set forth in FIG. 1.

In accordance with FIG. 1, a single operator 102 is positioned outside a stripping booth 104 at a computer console 106. In one embodiment, an automobile 108 is initially driven into the booth, as a car would be in a car wash. The operator 102 first scans the automobile with an array of imaging equipment 110 that is constructed and arranged to obtain a three-dimensional digitized image of a vehicle surface. The imaging equipment 110 is capable of mapping the areas of the automobile to a very high degree of accuracy.

In a particularly preferred embodiment, the digitized information is downloaded via the scanning procedure and may, if desirable, be compared to stored image data of an archived vehicle of the same design. This information can then be used to document the degree of damage or repair required as well as confirming its completion after the paint stripping and repair process is completed. This information can also be utilized at a later date by insurance companies to eliminate the possibilities of fraud.

Once the automobile 108 has been scanned, the operator can then select those areas which require stripping and initiate the process.

Figure 2:
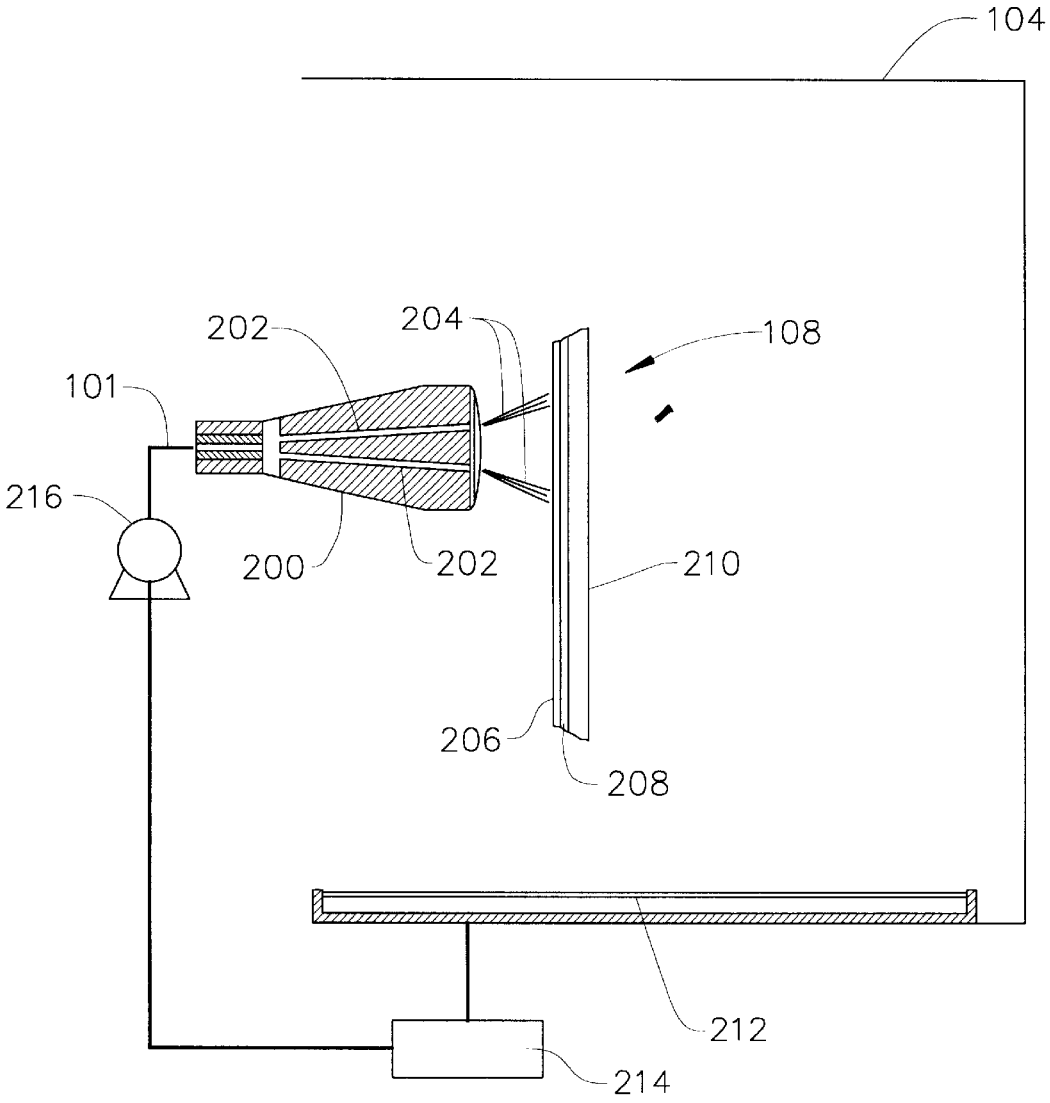
FIG. 2 illustrates the ultra-high pressure water nozzle paint removal system.

In accordance with FIG. 2, a rotating nozzle 200, in mechanical engagement with robotically controlled arm 101, and having a multiplicity of waterjets 202 similar to a showerhead rotating, is maintained at a controlled distance from the surface of a vehicle, e.g. automobile 108. The of ultra-high pressure water 204, directed through said waterjets and impinging upon the vehicle's surface, acts to selectively remove one or more layers of paint 206 without removing the factory applied primer 208 or otherwise injuring the underlying surface 210. The stripped paint and water falls to a grated floor 212 within the stripping booth 104 and is directed to a bank of filters 214 that capture the paint chips and recycle clean water in a closed loop back to the high pressure pump 216.

The pressure of the water can vary from 25,000–60,000 psi, depending on the volume of water and pressure used and the standoff distance from the automobile. Greater pressures allow further standoff distances. The preferred method is to have a minimal flow of water 1–3 gal per min at 30–60,000 psi.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A method as practiced on a computer for removal of one or more layers of paint/protective coatings from a surface of vehicles comprising:

providing a computer having a structured database containing stored digitized shapes of the surface of vehicles;

providing a device for selectively removing one or more layers of said paint/protective coating with ultra-high pressure waterjets; said device controlled by said computer;

selecting one of said stored digitized shapes to direct said device about said vehicle surface; and selecting said ultra-high pressure between 25,000 and 60,000 pounds per square inch to remove one or more layers of paint/protective coatings;

whereby the paint/protective coating removal via ultra-high pressure water is accomplished.

2. A method as practiced on a computer for removal of paint/protective coatings of claim 1 further comprising:

obtaining a digitized image of a surface of a vehicle by scanning said surface of said vehicle;

downloading said digitized image to said computer;

said computer comparing said downloaded image with said stored images and selecting an image from said stored images matching said vehicle; and directing said device about said vehicle.

3. A method as practiced on a computer for removal of paint/protective coatings of claim 1 further comprising:

rotating said ultra-high pressure waterjets of said device.

4. A method as practiced on a computer for removal of paint/protective coatings of claim 1 further comprising:

scanning a vehicle with a damaged surface and creating a digitized image of said damaged surface of said vehicle;

downloading said digitized image of said damaged surface to said computer; and directing said device about said damaged surface of said vehicle.

5. A method as practiced on a computer for removal of paint/protective coatings of claim 4 further comprising:

comparing said downloaded digitized image of said damaged surface with said stored images;

selecting said damaged surface of said downloaded digitized image; and directing said device about said damaged surface.

* * * * *